US010895120B2

(12) United States Patent
Yang et al.

(10) Patent No.: US 10,895,120 B2
(45) Date of Patent: Jan. 19, 2021

(54) MINE DRILL, DUST SUCTION HOOD AND DUST REMOVAL DEVICE THEREOF

(71) Applicants: China University of Mining and Technology, Jiangsu (CN); XUZHOU BOAN SCIENCE & TECHNOLOGY DEVELOPMENT CO., LTD, Jiangsu (CN)

(72) Inventors: Wei Yang, Jiangsu (CN); Baiquan Lin, Jiangsu (CN); Minghua Lin, Jiangsu (CN); Ru Jia, Jiangsu (CN); Changzheng Lu, Jiangsu (CN)

(73) Assignees: China University of Mining and Technology, Jiangsu (CN); XUZHOU BOAN SCIENCE & TECHNOLOGY DEVELOPMENT CO., LTD, Jiangsu (CN)

( * ) Notice: Subject to any disclaimer, the term of this patent is extended or adjusted under 35 U.S.C. 154(b) by 0 days.

(21) Appl. No.: 16/642,378

(22) PCT Filed: Oct. 29, 2018

(86) PCT No.: PCT/CN2018/112281
§ 371 (c)(1),
(2) Date: Feb. 27, 2020

(87) PCT Pub. No.: WO2019/144662
PCT Pub. Date: Aug. 1, 2019

(65) Prior Publication Data

US 2020/0199954 A1 Jun. 25, 2020

(30) Foreign Application Priority Data

Jan. 25, 2018 (CN) ..... 2018 1 0071080

(51) Int. Cl.
*E21B 21/015* (2006.01)
*E21F 5/20* (2006.01)
*E21B 21/01* (2006.01)

(52) U.S. Cl.
CPC ..... *E21B 21/015* (2013.01); *E21B 21/011* (2020.05); *E21F 5/20* (2013.01)

(58) Field of Classification Search
CPC ..... E21B 21/00; E21B 21/011; E21B 21/015; E21B 21/019
See application file for complete search history.

(56) References Cited

U.S. PATENT DOCUMENTS 1,223,027 A * 4/1917 Brackett ..... E21B 21/015 175/211
1,969,513 A * 8/1934 Kelley ..... B23Q 11/0046 175/209

(Continued)

FOREIGN PATENT DOCUMENTS

CN 202788917 3/2013
CN 203188947 9/2013

(Continued)

OTHER PUBLICATIONS

"International Search Report (Form PCT/ISA/210) of PCT/CN2018/112281", dated Jan. 24, 2019, with English translation thereof, pp. 1-5.

*Primary Examiner* — Blake E Michener
(74) *Attorney, Agent, or Firm* — JCIPRNET

(57) ABSTRACT

A dust suction hood includes a tapered outer cover, a cylindrical outer cover, a tapered inner baffle plate disposed in the tapered outer cover, and a first blocking member matched with an opening in the other end of the cylindrical outer cover. A top opening of the tapered outer cover is matched with an opening in one end of the cylindrical outer cover. A side wall opening of the cylindrical outer cover (Continued)

serves as a dust outlet. A first gap is formed in the tapered outer cover. A first dust suction port is formed between bottom openings of the tapered inner baffle plate and the tapered outer cover. A first drill pipe connecting port is formed in the first blocking member. A drill pipe of the mine drill passes through the first drill pipe connecting port to penetrate the dust suction hood on the drill pipe.

9 Claims, 2 Drawing Sheets

(56) References Cited

U.S. PATENT DOCUMENTS 1,981,570 A * 11/1934 Price ..... E21B 21/015 175/211
2,041,689 A * 5/1936 Baumeister ..... B23Q 11/0046 175/135
2,079,417 A * 5/1937 Markley ..... E21B 21/015 175/209
2,107,552 A * 2/1938 Smith ..... E21B 21/015 175/209
2,107,864 A * 2/1938 Hunter ..... E21B 21/015 175/209
2,122,517 A * 7/1938 Curtis ..... B23Q 11/006 175/135
2,144,586 A * 1/1939 Kelley ..... E21B 21/07 175/71
2,145,939 A * 2/1939 Markley ..... B23Q 11/0053 175/209
2,183,262 A * 12/1939 Kelley ..... B23Q 11/0046 175/209
2,590,958 A * 4/1952 Goodrich ..... B23Q 11/0046 175/209
2,829,867 A * 4/1958 Brochetti ..... E21B 21/015 175/209
2,859,940 A * 11/1958 Brochetti ..... E21B 21/015 175/209
3,045,769 A * 7/1962 Feucht ..... E21B 21/015 175/211
3,638,737 A * 2/1972 Moates ..... B23Q 11/0046 173/60
3,800,890 A * 4/1974 Gyongyosi ..... E21B 21/015 175/209
3,848,686 A * 11/1974 Jysky ..... B23Q 11/0053 175/209
3,965,998 A * 6/1976 Gyongyosi ..... E21B 21/015 175/209
4,100,982 A * 7/1978 Wilkinson ..... E21B 21/015 175/206
4,434,861 A * 3/1984 Howeth ..... B01D 45/04 175/66

FOREIGN PATENT DOCUMENTS

| | | |
|---|---|---|
| CN | 203879428 | 10/2014 |
| CN | 206376771 | 8/2017 |
| CN | 108266141 | 7/2018 |
| SU | 1499056 | 8/1989 |
| WO | 2011035377 | 3/2011 |

* cited by examiner

MINE DRILL, DUST SUCTION HOOD AND DUST REMOVAL DEVICE THEREOF

CROSS-REFERENCE TO RELATED APPLICATION

This application is a 371 of international application of PCT application serial no. PCT/CN2018/112281, filed on Oct. 29, 2018, which claims the priority benefit of China application no. 201810071080.8, filed on Jan. 25, 2018. The entirety of each of the above mentioned patent applications is hereby incorporated by reference herein and made a part of this specification.

BACKGROUND

Technical Field

The present invention relates to the technical field of mine equipment, and particularly relates to a dust suction hood of a mine drill, a dust removal device of a mine drill and a mine drill.

Description of Related Art

Coal mine underground drilling is a general technique for gas drainage and coal seam water injection, and is divided into wet drilling and dry drilling. At present, the dry drilling generally uses compressed air as a circulating medium, and dust produced by the drilling is blown out along a gap between a drill pipe and a hole wall, resulting in an extremely high concentration of the produced dust, which greatly contaminates a working space and a working face of a roadway and causes a severe impact on the health of operators. A smoky working environment has a potential safety hazard.

At present, dry drilling dust removal is performed by disposing a dust collection hood in the related art. However, the installation of the dust collection hood affects both the observation of a drilling situation and the normal drilling work; and moreover, it is relatively cumbersome to determine and set the position of the dust collection hood, and the dust removal effect is not good enough.

SUMMARY

The present invention aims to solve one of the technical problems in the above technique to a certain extent. Therefore, one objective of the present invention is to provide a dust suction hood of a mine drill, which can effectively remove dust produced by drilling work and is simple in structure and convenient to operate and use.

A second objective of the present invention is to provide a dust removal device of a mine drill.

A third objective of the present invention is to provide a mine drill.

In order to achieve the above objectives, the dust suction hood of the mine drill, provided by the embodiment of the first aspect of the present invention includes a tapered outer cover, a cylindrical outer cover, a tapered inner baffle plate and a first blocking member. A top opening of the tapered outer cover is matched with an opening in one end of the cylindrical outer cover. A side wall opening of the cylindrical outer cover serves as a dust outlet of the dust suction hood. A first gap is formed in the tapered outer cover along a generatrix direction. The tapered inner baffle plate is correspondingly disposed in the tapered outer cover. A second gap is formed in a position, corresponding to the first gap, on the tapered inner baffle plate. A bottom opening of the tapered inner baffle plate is smaller than a bottom opening of the tapered outer cover. A first dust suction port is formed between the bottom opening of the tapered inner baffle plate and the bottom opening of the tapered outer cover. At least one second dust suction port is formed in a side wall of the tapered inner baffle plate. The first blocking member is matched with an opening in the other end of the cylindrical outer cover, and a first drill pipe connecting port is formed in the first blocking member. A drill pipe of the mine drill passes through the first drill pipe connecting port so as to penetrate the dust suction hood on the drill pipe.

The dust suction hood of the mine drill according to the embodiment of the present invention effectively removes the dust produced by the drilling work by arranging the tapered inner baffle plate in the tapered outer cover, forming the gaps in the tapered outer cover and the tapered inner baffle plate, forming the dust suction ports in the tapered inner baffle plate and arranging the drill pipe connecting ports, used to arrange the dust suction hood on the drill pipe in the penetrating manner, on the first blocking member that blocks the cylindrical outer cover, and is simple in structure and convenient to operate and use.

In addition, the dust suction hood of the mine drill according to the embodiment of the present invention also has following additional technical features.

Further, the dust suction hood of the mine drill further includes a second blocking member. The second blocking member is matched with a top opening of the tapered inner baffle plate. A second drill pipe connecting port is formed in the second blocking member. The drill pipe of the mine drill passes through the first drill pipe connecting port and the second drill pipe connecting port so as to penetrate the dust suction hood on the drill pipe.

According to one embodiment of the present invention, an included angle between generatrixes on two sides of the first gap or the second gap is 165 to 180 degrees.

According to one embodiment of the present invention, each of the first blocking member and the second blocking member includes a connecting bearing, drill pipe filler, an annular blocking plate and a shock absorption material. The drill pipe filler is disposed between an inner wall of an inner ring of the connecting bearing and the drill pipe. An outer ring of the annular blocking plate is connected with the opening in the other end of the cylindrical outer cover or the top opening of the tapered inner baffle plate to block the opening in the other end of the cylindrical outer cover or the top opening of the tapered inner baffle plate. The shock absorption material is disposed between an outer wall of an outer ring of the connecting bearing and an inner ring of the annular blocking plate.

According to one embodiment of the present invention, the tapered inner baffle plate and the tapered outer cover are connected to each other through a baffle plate connecting shaft.

In order to achieve the above objectives, the dust removal device of the mine drill, provided by the embodiment of the second aspect of the present invention, includes the dust suction hood provided by the embodiment of the first aspect of the present invention, a connecting and moving mechanism and a dust removal equipment. The connecting and moving mechanism is connected with the dust suction hood and a slideway of the mine drill. The dust removal equipment is connected with the dust outlet of the dust suction hood through a first dust removal guide tube.

The dust removal device of the mine drill according to the embodiment of the present invention not only effectively removes dust produced by drilling work, but also further improves the convenience of operation and use.

In addition, the dust removal device of the mine drill according to the above embodiment of the present invention also has following additional technical features.

According to one embodiment of the present invention, the connecting and moving mechanism includes a first fixed shaft, a telescopic pole and a second fixed shaft. The first fixed shaft has a bent part. One end of the first fixed shaft is connected with a fixed end on the side wall of the cylindrical outer cover. One end of the telescopic pole is connected with the other end of the first fixed shaft. One end of the second fixed shaft is connected with the other end of the telescopic pole, and the other end of the second fixed shaft is connected with the slideway of the mine drill.

According to one embodiment of the present invention, the mine drill includes a drill gyrator. The drill gyrator in running drives a drill pipe to do drilling so as to realize drilling work. The dust removal equipment includes a cyclone dust collector and a suction fan. An air inlet of the cyclone dust collector is connected with the dust outlet through the first dust removal guide tube. An air suction port of the suction fan is connected with an air outlet of the cyclone dust collector through a second dust removal guide tube, and the suction fan is in power connection with the drill gyrator through a transmission mechanism. The drill gyrator in running drives the suction fan to operate to suck dusty air produced by the drilling of the drill pipe at the dust suction hood into the cyclone dust collector for dust removal, and the dust-removed air is sucked into the suction fan and discharged through an exhaust outlet of the suction fan.

Further, the dust removal equipment also includes a gearbox. An input shaft of the gearbox is in power connection with the drill gyrator through the transmission mechanism, and an output shaft of the gearbox is in power connection with the suction fan. The gearbox is used for adjusting a rotating speed of the suction fan.

In order to achieve the above objectives, the mine drill provided by the embodiment of the third aspect of the present invention includes the dust removal device of the mine drill, provided by the embodiment of the second aspect of the present invention.

The mine drill according to the embodiment of the present invention effectively removes dust produced by drilling work and is relatively high in convenience of operation and use.

One part of the additional aspects and advantages of the present invention is described below, and the part becomes obvious in the descriptions below or known via the practice of the present invention.

DESCRIPTION OF THE EMBODIMENTS

Figure 1:
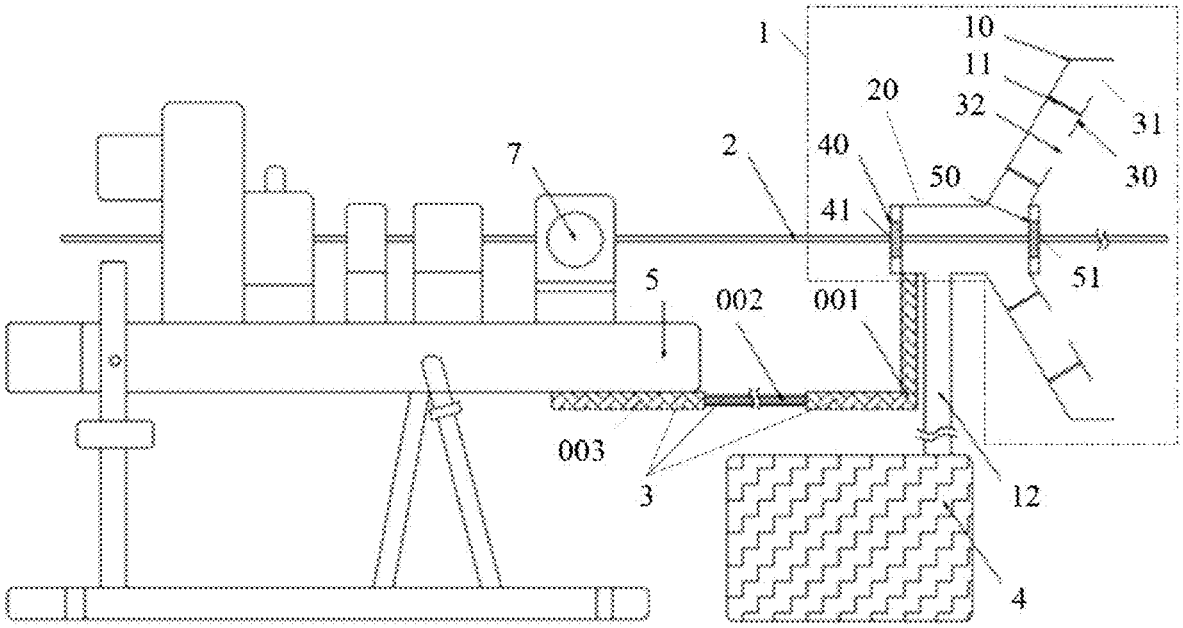
FIG. 1 is a schematic structural view of a mine drill including a dust suction hood according to one embodiment of the present invention.

The embodiments of the present invention are described in detail below, and the examples of the embodiments are illustrated in the drawings. The same or similar reference numerals refer to the same or similar elements or elements with the same or similar functions throughout. The embodiments described below with reference to the drawings are illustrative and intended to be explanatory of the present invention and are not to be construed as limiting the present invention.

A mine drill and a dust suction hood and a dust removal device thereof of the embodiments of the present invention are described below in combination with the drawings.

Figure 2:
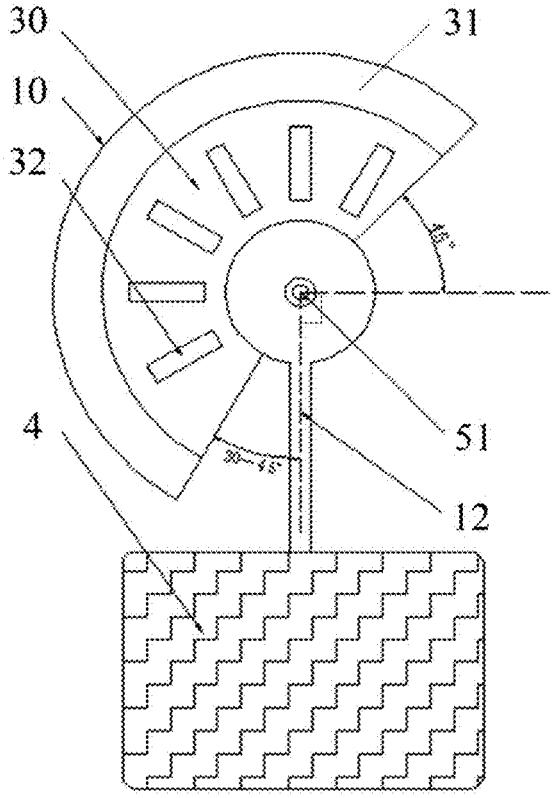
FIG. 2 is a schematic structural view of the dust suction hood according to the embodiment of the present invention.

As shown in FIG. 1 and FIG. 2, a dust suction hood 1 of a mine drill of the embodiment of the present invention includes a tapered outer cover 10, a cylindrical outer cover 20, a tapered inner baffle plate 30 and a first blocking member 40.

A top opening of the tapered outer cover 10 is matched with an opening in one end of the cylindrical outer cover 20. A side wall opening of the cylindrical outer cover 20 serves as a dust outlet of the dust suction hood 1. A first gap is formed in the tapered outer cover 10 along a generatrix direction. The tapered inner baffle plate 30 is correspondingly disposed in the tapered outer cover 10. A second gap is formed in a position, corresponding to the first gap, on the tapered inner baffle plate 30. The tapered inner baffle plate 30 and the tapered outer cover 10 are connected to each other through a baffle plate connecting shaft 11. A bottom opening of the tapered inner baffle plate 30 is smaller than a bottom opening of the tapered outer cover 30. A first dust suction port 31 is formed between the bottom opening of the tapered inner baffle plate 30 and the bottom opening of the tapered outer cover 10. At least one second dust suction port 32 is formed in a side wall of the tapered inner baffle plate 30. The first blocking member 40 is matched with an opening in the other end of the cylindrical outer cover 20, and a first drill pipe connecting port 41 is formed in the first blocking member 40. A drill pipe 2 of the mine drill passes through the first drill pipe connecting port 41 so as to penetrate the dust suction hood 1 on the drill pipe 2.

Further, as shown in FIG. 1 and FIG. 2, the dust suction hood 1 of the mine drill also includes a second blocking member 50. The second blocking member 50 is matched with a top opening of the tapered inner baffle plate 30. A second drill pipe connecting port 51 is formed in the second blocking member 50. The drill pipe 2 of the mine drill passes through the first drill pipe connecting port 41 and the second drill pipe connecting port 51 so as to penetrate the dust suction hood 1 on the drill pipe 2.

As shown in FIG. 2, an included angle between generatrixes on two sides of the first gap or the second gap is 165 to 180 degrees, preferably 165 degrees.

Figure 3:
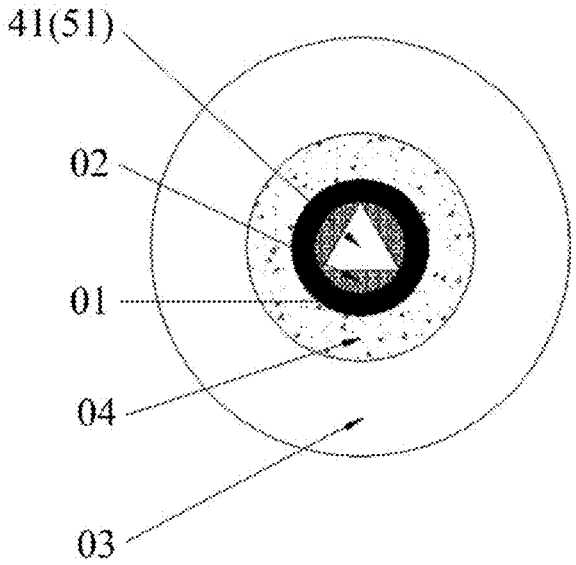
FIG. 3 is a schematic structural view of a blocking member according to the embodiment of the present invention.

In one embodiment of the present invention, as shown in FIG. 3, each of the first blocking member 40 and the second blocking member 50 includes a connecting bearing 01, drill pipe filler 02, an annular blocking plate 03 and a shock absorption material 04. The drill pipe filler 02 is disposed between an inner wall of an inner ring of the connecting bearing 01 and the drill pipe 2. An outer ring of the annular blocking plate 03 is connected with the opening in the other end of the cylindrical outer cover 20 or the top opening of the tapered inner baffle plate 30, to block the opening in the other end of the cylindrical outer cover 20 or the top opening of the tapered inner baffle plate 30. The shock absorption material 04 is disposed between an outer wall of an outer ring of the connecting bearing 01 and an inner ring of the annular blocking plate 03.

When the mine drill is used to perform the drilling work, internal pressure wind of a drilled hole sprays dust from the hole. The dust flows towards a downwind direction of a roadway wind flow under the influence of the roadway wind flow, and the dust suction hood 1 is disposed in the downwind direction of the wind flow, with the gaps located windward, so that the dust is sucked through the first dust suction port 31 and the second dust suction port 32, then passes through a cavity between the tapered inner baffle 30 and the tapered outer cover 10 and a cavity in the cylindrical outer cover 20 and is discharged from the dust outlet, and a better dust suction effect is achieved.

The shape and the proportion of the second dust suction port 32 in the above structure are designed according to an actual application requirement, so that a good dust suction effect is achieved.

The first gap and the second gap in the dust suction hood 1 enables blocky particles at a drilling port to naturally drop down from the gaps under the influence of the gravity, and an operator conveniently observes dust flowing and drilling slag discharging situations of the dust suction hood 1 through the gaps.

A joint between the drill pipe 2 and the connecting bearing 01 is a universal design, and is applied to mine drills with drill pipes 2 of different specifications. The shock absorption material 04, such as a sponge pad, between the drill pipe 2 and the dust suction hood 1 copes with shocks generated during the operation, thereby reducing damage to a drill bit and prolonging the overall life of the mine drill.

The dust suction hood of the mine drill according to the embodiment of the present invention effectively removes the dust produced by the drilling work by arranging the tapered inner baffle plate in the tapered outer cover, forming the gaps in the tapered outer cover and the tapered inner baffle plate, forming the dust suction ports in the tapered inner baffle plate and arranging the drill pipe connecting ports, used to arrange the dust suction hood on the drill pipe in the penetrating manner, on the first blocking member that blocks the cylindrical outer cover, and is simple in structure and convenient to operate and use.

Corresponding to the above embodiment, the present invention also provides a dust removal device of a mine drill.

As shown in FIG. 1, the dust removal device of the mine drill of the embodiment of the present invention includes the dust suction hood 1 of the above embodiment, a connecting and moving mechanism 3 and dust removal equipment 4.

The connecting and moving mechanism 3 is connected with the dust suction hood 1 and a slideway 5 of the mine drill. The dust removal equipment 4 is connected with the dust outlet of the dust suction hood 1 through a first dust removal guide tube 12.

Further, as shown in FIG. 1, the connecting and moving mechanism 3 includes a first fixed shaft 001, a telescopic pole 002 and a second fixed shaft 003. The first fixed shaft 001 has a bent part. One end of the first fixed shaft 001 is connected with a fixed end on the side wall of the cylindrical outer cover 20. One end of the telescopic pole 002 is connected with the other end of the first fixed shaft 001. One end of the second fixed shaft 003 is connected with the other end of the telescopic pole 002, and the other end of the second fixed shaft 003 is connected with the slideway 5 of the mine drill.

In the embodiment of the present invention, the telescopic pole 002 is parallel to the drill pipe 2. The dust suction hood 1 slides on the drill pipe 2 by the extension and retraction of the telescopic pole 002, so that the position of the dust suction hood 1 is conveniently changed according to the drilling of the drill pipe 2 and an actual dust removal requirement.

In one specific embodiment of the present invention, when the mine drill performs the drilling work, the following steps are implemented.

a. The arrangement direction of the dust suction hood 1 is adjusted, and the dust suction hood 1 is disposed in the downwind direction of the roadway wind flow, with the gaps located windward b. The telescopic pole 002 is adjusted, and the dust suction hood 1 is adjusted to a position of about 0.5 m from the drilling port. In extreme cases, the dust suction hood 1 is attached to a working wall surface to achieve a better dust removal effect.

c. During the drilling, blocky particles at the drilling port naturally drop down from the gap part of the dust suction hood 1 due to the influence of the gravity, that is, the blocky particles neither enter the dust suction hood 1 nor cause dust pollution.

d. A large number of small dust particles are sprayed out from the drilling port, and the dust is sucked into a cavity of the dust suction hood 1 through the dust suction ports 31 and 32.

e. The dust in the cavity of the dust suction hood 1 enters the dust removal equipment from the dust outlet due to the influence of a negative pressure, and is finally cleaned and removed. The dust removal equipment generates the negative pressure, which is further described in the following embodiments.

During the above drilling work, the operator observes the dust flowing and drilling slag discharging situations through the gap of 165 degrees on the dust suction hood 1, so that timely adjustment is made during the drilling work.

In addition, when the drilling work produces a large amount of dust at a high concentration and with a high speed, the second blocking member 50 at the tapered inner baffle plate 30 of the dust suction hood 1 is detached, thereby enlarging the dust suction area to achieve a better dust removal effect.

Figure 4:
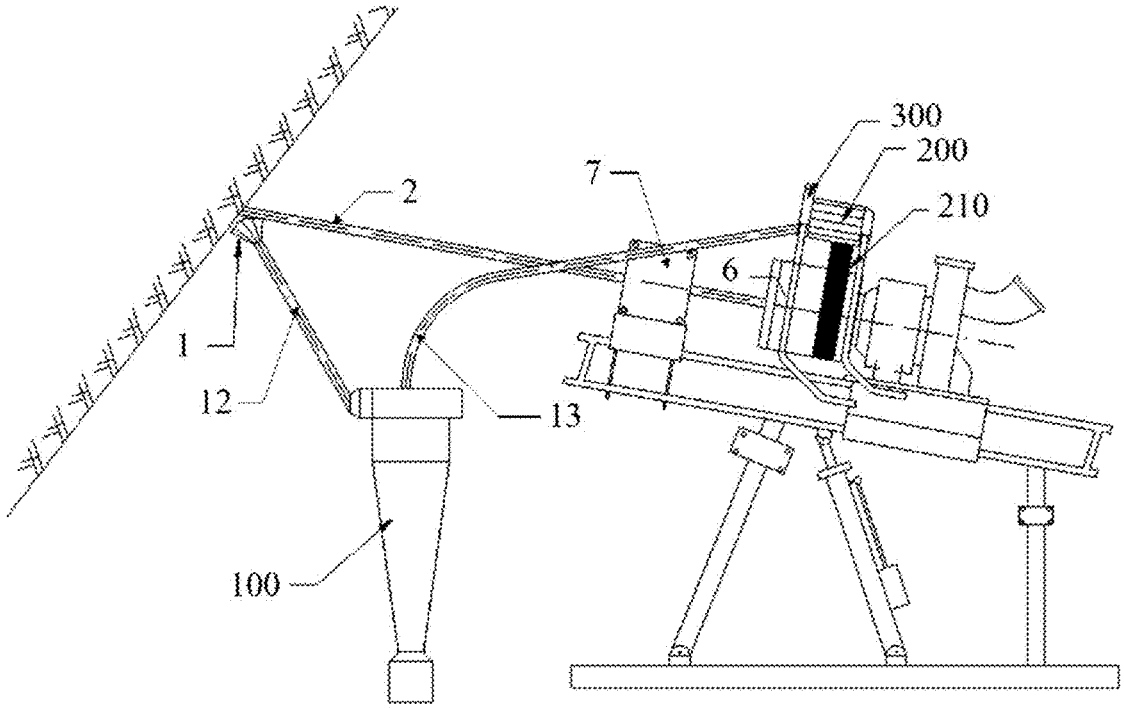
FIG. 4 is a schematic structural view of the mine drill including dust removal equipment according to the embodiment of the present invention.

Further, as shown in FIG. 4, the mine drill of the embodiment of the present invention includes a drill gyrator 6 and a drill pipe clamp 7. The drill pipe clamp 7 is used to clamp the drill pipe 2 to limit the drill pipe 2 to do drilling along its lengthwise direction. The drill gyrator 6 in running drives the drill pipe 2 to do drilling so as to realize the drilling work. The dust removal equipment of the embodiment of the present invention includes a cyclone dust collector 100 and a suction fan 200. An air inlet of the cyclone dust collector 100 is connected with the dust outlet of the dust suction hood 1 through the first dust removal guide tube 12. The first dust removal guide tube 12 and the dust outlet are connected to each other through a flange. An air suction port of the suction fan 200 is connected with an air outlet of the cyclone dust collector 100 through a second dust removal guide tube 13, and the suction fan 200 is in power connection with the drill gyrator 6 through a transmission mechanism. When the mine drill is started to work, the drill gyrator 6 in running drives the suction fan 200 to operate to suck dusty air produced by the drilling of the drill pipe 2 at the dust suction hood 1 into the cyclone dust collector 100 for dust removal, and the dust-removed air is sucked into the suction fan 200 and discharged through an exhaust outlet of the suction fan 200.

In one embodiment of the present invention, the transmission mechanism includes a conveying belt or a gear.

Referring to FIG. 4, a working process of the dust removal equipment is described below by taking the transmission mechanism including the conveying belt 210 for example. When the mine drill is started and drills in a coal wall, the drill gyrator 6 in running drives the drill pipe 2 and also drives a wind wheel in the suction fan 200 to rotate. The negative pressure generated by the rotation of the wind wheel provides air flow rotation power for the cyclone dust collector 100. The negative pressure is transmitted to the dust suction hood 1 to suck the dusty air at the drilling port. When the dusty air enters the cyclone dust collector 100, the air flow is changed from a linear motion into a circular motion, thus forming a rotating air flow. Most of the rotating air flow spirally downwards flows along the wall of the cyclone dust collector 100 towards a cone of the cyclone dust collector 100. The dusty air generates a centrifugal force in the rotating process and then throws the dust particles heavier than air to the wall. Once in contact with the wall, the dust particles lose an inertia force and drop down along a wall surface depending on a momentum of an inlet velocity and the downward gravity, and then enter an ash discharging tube of the cyclone dust collector 100. The spirally downward rotating air flow is gathered to the center of the cyclone dust collector 100 due to the retraction of the cone when reaching the cone. When reaching a certain position at the lower end of the cone, the rotating air flow continues to spirally flow in the same rotating direction from the middle part of the cyclone dust collector 100, reversely from bottom to top, then enters the suction fan 200 through the air outlet of the cyclone dust collector 100 and is discharged through the exhaust outlet of the suction fan 200.

Therefore, the dust removal effect is guaranteed, the working environment for the drilling work is optimized, and the safety of the drilling work is improved. Moreover, the structure of the mine drill is simplified, so that the flexibility and the usage convenience of the mine drill are improved.

The above process of removing the dust through the cyclone dust collector effectively removes dust with a large particle size (such as coal dust with a diameter more than 5 μm) from the dusty air. Actually, the dusty air also includes some respirable dust with a small particle size (such as dust with a diameter less than 5 μm). In order to effectively remove the respirable dust, in one embodiment of the present invention, as shown in FIG. 4, the dust removal equipment also includes a dust removal filter net 300. The dust removal filter net 300 is disposed at the exhaust outlet of the suction fan 200. The dust removal filter net 300 is used for filtering air discharged from the exhaust outlet of the suction fan 200.

Therefore, completely purified air is discharged after the air is subjected to primary purification of the cyclone dust collector and secondary purification of the dust removal filter net, and the dust removal effect is relatively good.

Further, the dust removal equipment of the embodiment of the present invention also includes a gearbox. An input shaft of the gearbox is in power connection with the drill gyrator 6 through the transmission mechanism (including, for example, the conveying belt, the gear, etc.), and an output shaft of the gearbox is in power connection with the suction fan 200. The gearbox is used for adjusting a rotating speed of the suction fan 200. Different negative pressures and air suction amounts are generated by adjusting the rotating speed of the suction fan 200, thereby conveniently changing the dust removal amount according to the amount of the dust produced by the drilling. It should be understood that since the drill gyrator 6 is used to drive the drill pipe 2 to do drilling so as to realize the drilling work, during the drilling work, a rotating speed of the drill gyrator 6 is generally adjusted according to a requirement for rotating speed or a requirement for drilling force of the drill pipe 2 instead of a requirement for dust removal amount. In view of this, the gearbox with a plurality of gears is disposed. When the gearbox is shifted to different gears, the rotating speed of the suction fan 200 is changed, thereby adjusting the dust removal amount. Therefore, the mine drill of the embodiment of the present invention is allowed to adapt to various occasions by arranging the gearbox in the dust removal equipment.

In addition, it should be noted that in other embodiments of the present invention, a plurality of cyclone dust collectors is provided. The plurality of cyclone dust collectors is connected in parallel between the dust suction hood and the suction fan, that is, the air inlet of each cyclone dust collector is connected with the dust suction hood through a dust removal guide tube, and the air outlet of each cyclone dust collector is connected with the air suction port of the suction fan. Therefore, the dust removal effect is further enhanced by simultaneous work of the plurality of cyclone dust collectors.

The dust removal device of the mine drill according to the embodiment of the present invention not only effectively removes the dust produced by the drilling work, but also further improves the convenience of operation and use.

The dust suction hood and the dust removal device of the mine drill of the above embodiments are arranged on the mine drill, so that integration of drilling and dust removal of the mine drill is realized. When the drilling of a certain position is completed, the dust suction hood, the dust removal equipment and the mine drill body are moved to the next working site together, so that the underground working efficiency is greatly improved.

Corresponding to the above embodiment, the present invention also provides a mine drill.

The mine drill of the embodiment of the present invention includes the dust removal device of the mine drill, provided by the above embodiment of the present invention. The specific implementation of the dust removal device is referred to the above embodiment. In order to avoid redundancy, no repeated descriptions are described here.

The mine drill according to the embodiment of the present invention effectively removes dust produced by drilling work and is relatively high in convenience of operation and use.

In the description of the present invention, it should be understood that unless otherwise clearly specified or defined, "a plurality of" means two or more. Terms such as "mounting", "connected", "connecting" and "fixed" shall be general understandings. For example, fixed connection, detachable connection, or integrated connection is possible. Direct connection, and also indirect connection through an intermediate are possible. Communication of insides of two elements or an interaction relation of the two elements is possible. Those of ordinary skill in the art understand specific meanings of the foregoing terms in the present invention according to specific situations.

In the description of the present description, descriptions with reference to terms such as "one embodiment" and "some embodiments" mean that specific features, structures, materials or characteristics described in the embodiments or examples are included in at least one embodiment or example of the present invention. In the present description, the schematic representations of the foregoing terms are not necessarily directed to the same embodiment or example. Furthermore, the particular features, structures, materials or characteristics described are combined in a suitable manner in any one or more embodiments or examples. Moreover, those skilled in the art connect and combine different embodiments or examples described in the present description and features of different embodiments or examples without mutual conflict.

Although the embodiments of the present invention have been shown and described above, it can be understood that the foregoing embodiments are illustrative and are not intended to be understood as limiting the present invention. Those of ordinary skill in the art make changes, modifications, replacements and variations without departing from the scope of the present invention.

What is claimed is:

1. A dust suction hood of a mine drill, the dust suction hood comprising:

a tapered outer cover and a cylindrical outer cover, wherein a top opening of the tapered outer cover is matched with an opening in one end of the cylindrical outer cover; a side wall opening of the cylindrical outer cover serves as a dust outlet of the dust suction hood; a first gap is formed in the tapered outer cover along a generatrix direction;

a tapered inner baffle plate, wherein the tapered inner baffle plate is correspondingly disposed in the tapered outer cover; a second gap is formed in a position, corresponding to the first gap, on the tapered inner baffle plate; a bottom opening of the tapered inner baffle plate is smaller than a bottom opening of the tapered outer cover; a first dust suction port is formed between the bottom opening of the tapered inner baffle plate and the bottom opening of the tapered outer cover; at least one second dust suction port is formed in a side wall of the tapered inner baffle plate; and a first blocking member, wherein the first blocking member is matched with an opening in the other end of the cylindrical outer cover, and a first drill pipe connecting port is formed in the first blocking member; and a drill pipe of the mine drill passes through the first drill pipe connecting port so as to penetrate the dust suction hood on the drill pipe.

2. The dust suction hood of the mine drill according to claim 1, the dust suction hood further comprising:

a second blocking member, wherein the second blocking member is matched with a top opening of the tapered inner baffle plate; a second drill pipe connecting port is formed in the second blocking member; and the drill pipe of the mine drill passes through the first drill pipe connecting port and the second drill pipe connecting port so as to penetrate the dust suction hood on the drill pipe.

3. The dust suction hood of the mine drill according to claim 2, wherein each of the first blocking member and the second blocking member comprises:

a connecting bearing;

drill pipe filler, disposed between an inner wall of an inner ring of the connecting bearing and the drill pipe;

an annular blocking plate, wherein an outer ring of the annular blocking plate is connected with the opening in the other end of the cylindrical outer cover or the top opening of the tapered inner baffle plate, to block the opening in the other end of the cylindrical outer cover or the top opening of the tapered inner baffle plate; and a shock absorption material, wherein the shock absorption material is disposed between an outer wall of an outer ring of the connecting bearing and an inner ring of the annular blocking plate.

4. The dust suction hood of the mine drill according to claim 1, wherein an included angle between generatrixes on two sides of the first gap or the second gap is 165 to 180 degrees.

5. The dust suction hood of the mine drill according to claim 1, wherein the tapered inner baffle plate and the tapered outer cover are connected to each other through a baffle plate connecting shaft.

6. A dust removal device of a mine drill, the dust removal device comprising:

the dust suction hood according to claim 1;

a connecting and moving mechanism, wherein the connecting and moving mechanism is connected with the dust suction hood and the mine drill; and dust removal equipment, wherein the dust removal equipment is connected with the dust outlet of the dust suction hood through a first dust removal guide tube.

7. The dust removal device of the mine drill according to claim 6, wherein the connecting and moving mechanism comprises:

a first fixed shaft, wherein the first fixed shaft has a bent part; one end of the first fixed shaft is connected with a fixed end on a side wall of the cylindrical outer cover;

a telescopic pole, wherein one end of the telescopic pole is connected with the other end of the first fixed shaft; and a second fixed shaft, wherein one end of the second fixed shaft is connected with the other end of the telescopic pole, and the other end of the second fixed shaft is connected with the mine drill.

8. The dust removal device of the mine drill according to claim 6, wherein the mine drill comprises a drill gyrator; the drill gyrator in running drives the drill pipe to do drilling so as to realize drilling work; the dust removal equipment comprises:

a cyclone dust collector, wherein an air inlet of the cyclone dust collector is connected with the dust outlet through the first dust removal guide tube; and a suction fan, wherein an air suction port of the suction fan is connected with an air outlet of the cyclone dust collector through a second dust removal guide tube, and the suction fan is in power connection with the drill gyrator through a transmission mechanism;

the drill gyrator in running drives the suction fan to operate to suck dusty air produced by the drilling of the drill pipe at the dust suction hood into the cyclone dust collector for dust removal, and the dust-removed air is sucked into the suction fan and discharged through an exhaust outlet of the suction fan.

9. The dust removal device of the mine drill according to claim 8, wherein the dust removal equipment further comprises:

a gearbox, wherein an input shaft of the gearbox is in power connection with the drill gyrator through the transmission mechanism, and an output shaft of the gearbox is in power connection with the suction fan; and the gearbox is used for adjusting a rotating speed of the suction fan.

* * * * *